United States Patent [19]

Koshizuka et al.

[11] Patent Number: 4,542,094

[45] Date of Patent: Sep. 17, 1985

[54] SILVER HALIDE EMULSION

[75] Inventors: Kunihiro Koshizuka, Kodaira; Syoji Matsuzaka, Hachioji; Takaaki Kojima, Odawara, all of Japan

[73] Assignee: Konishiroku Photo Industry Co., Ltd., Tokyo, Japan

[21] Appl. No.: 544,238

[22] Filed: Oct. 21, 1983

[30] Foreign Application Priority Data

Oct. 22, 1982 [JP] Japan ..... 57-184499
Apr. 18, 1983 [JP] Japan ..... 58-69052

[51] Int. Cl.[4] ..... G03C 1/02

[52] U.S. Cl. ..... 430/569; 430/550; 430/551; 430/600; 430/603; 430/611; 430/613; 430/614; 430/615

[58] Field of Search ..... 430/600, 603, 613, 611, 430/614, 615, 569, 550, 551

[56] References Cited

U.S. PATENT DOCUMENTS 4,078,937 3/1978 Tani et al. ..... 430/600
4,088,494 5/1978 Tani ..... 430/600
4,221,857 9/1980 Okutsu et al. ..... 430/264
4,328,302 5/1982 Nishimura et al. ..... 430/611
4,332,888 6/1982 Corben ..... 430/615
4,349,622 9/1982 Koitabashi et al. ..... 430/567

FOREIGN PATENT DOCUMENTS 127714 11/1978 Japan ..... 430/615
141027 12/1978 Japan ..... 430/615
1457818 12/1976 United Kingdom ..... 430/615

*Primary Examiner*—Mary F. Downey
*Attorney, Agent, or Firm*—Finnegan, Henderson, Farabow, Garrett & Dunner

[57] ABSTRACT

A novel silver halide emulsion is disclosed. This silver halide emulsion comprises in combination (a) silver halide made of silver chlorobromide or silver chlorobromoiodide, (b) a hydroxytetrazaindene compound and (c) a nitrogen-containing heterocyclic compound having at least one mercapto group, the grains of said silver halide having such a size distribution that the variation co-efficient is not more than 0.15.

6 Claims, No Drawings

SILVER HALIDE EMULSION

BACKGROUND OF THE INVENTION

1. Field of the Invention

The present invention relates to a silver halide emulsion suitable for preparing a photosensitive emulsion layer to be incorporated in silver halide photographic paper. More particularly, the invention relates to a silver halide emulsion that ensures improved stability in photographic properties against variations in the concentrations of bromide ions in developing solutions and which provides an emulsion coating with improved longterm stability.

2. Description of the Prior Art

In order to meet the recent demand for rapid processing of silver halide photographic materials, most modern large-scale laboratories use automatic processors that enable running processing. However, one big problem with this system is that the composition of the processing solution and process conditions vary from one laboratory to another and even within the same laboratory, and as a result, the photographic characteristics of the materials being processed fluctuate so greatly that products of consistent performance cannot be obtained. It is generally understood that this variation in the composition of the processing solution and the process conditions is caused mainly due to the dissolution of photographically active materials out of the photographic material under running processing and their accumulation in the processing solution. In order to prevent the variation in the process conditions, it is necessary to effect a high degree of control over the development period, the temperature of the developing solution, its pH, and the concentration of halide ions, particularly, bromide ions in the developing solution. However, the concentration of bromide ions in the developing solution is more difficult to control than the development period and the temperature of the developing solution because their concentration defies a very accurate determination.

It is therefore necessary to obtain a highly stable silver halide emulsion the photographic characteristics of which are less dependent on the concentration of bromide ions. Needless to say, this stability should not be achieved by sacrificing the most basic properties of photographic materials, namely, speed (sensitivity), fog resistance and gradation in tone. Among other things, silver halide emulsions for use in photographic paper require particularly rapid development, and inevitably, they contain chloride in the silver halide. In this case, the requirements to be met are high gradation and low fog rather than high speed.

Hydroxytetrazaindene compounds and mercapto compounds are conventionally known as stabilizers, antifoggants or desensitizers for photographic emulsions. A detailed discussion of hydroxytetrazaindene compounds is found in V. C. Chambers, "A Corelation of the Chemical Structures of Some Triazolo Pigments with their Photographic Effects" in "Photographic Science & Engineering", vol. 6, No. 2. Details of mercapto compounds are given in, for example, "The Thory of the Photographic Process", 3rd ed. edited by C. E. Kenneth Mees and T. H. James, The Macmillan Company, chapter 15, pp. 344–346.

It is also known that hydroxytetrazaindene or mercapto compounds can function as sensitizers within emulsions. For example, Japanese patent application (OPI) No. 63914/75 (the symbol OPI as used herein means an unexamined published Japanese patent application) and West German patent application (OLS) No. 2,419,798 show that a higher sensitivity can be attained by incorporating hydroxytetrazaindene compounds in sulfur-sensitized monodisperse silver halide emulsions comprising cubic grains with a silver bromide content of 80 mol % or more. Japanese patent application (OPI) No. 36130/76 show that a higher sensitivity can also be achieved by combining a mercaptocontaining heterocyclic compound having 2 or more nitrogen atoms and a PKa of 7.6 or less with sulfur-sensitized silver halide grains in cubic form having a (100) plane and containing at least 80 mol % of silver bromide or chloride. There are many other prior art references that show the incorporation in emulsions of either hydroxytetrazaindene compounds or mercapto compounds or both. However, no prior art references have shown techniques for providing stability against variations in the concentration of bromide ions in the developing solution. There is also no prior art teaching of combining an emulsion of highly monodispersity with both a hydroxytetrazaindene compound and a nitrogen-containing heterocyclic compound having at least one mercapto group.

In the development of common silver halide emulsions, desensitization and change in gradation occur as the concentration of bromide ions in the developing solution increases. The most immediate cause of these phenomena would be the decrease in the electric potential of the developing solution due to the increasing concentration of bromide ions. Other factors would be the interaction between bromide ions and the developing nuclei, and the conversion of other halide ions to bromide ions. For whichever reason, these factors determine the developing speed, and the desensitization or the change in gradation may well be explained by the change in developing speed.

It is common sense in the art that the increase in the size of silver halide grains is accompanied by higher sensitivity and lower developing speed. Silver halide emulsions comprising small grains and having high chlorine content, for example, those having fairly high developing speed such as silver chlorobromide or chlorobromoiodide emulsions for photographic paper, have a tendency to desensitize and provide a harder tone as the concentration of bromide ions in the developing solution increases. This means that the toe of the photographic characteristic curve suffers a great degree of desensitization whereas the shoulder experiences only a small degree of desensitization.

When silver halide grains do not have a high degree of monodispersity, the sensitivity of toe region in the characteristic curve depends on larger grains. Therefore, the above described tendency toward hard tone that accompanies the increasing concentration of bromide ions in the developing solution seems to be attributable to the greater inhibition of development by larger grains. Based on this assumption, the present inventors expected that the variation in the toe sensitivity would be reduced to a level comparable with the variation in the shoulder sensitivity by using silver halide grains of high monodispersity. However, as it turned out, the desired stability could not be obtained by simply using silver halide grains having a high degree of monodispersity.

SUMMARY OF THE INVENTION

The object of the present invention is to provide a silver halide emulsion that is highly stabilized against variations in the concentration of bromide ions in the developing solution and which ensures good photographic properties.

This object of the present invention can be achieved by a silver halide emulsion having in combination (a) silver halide made of silver chlorobromide or silver chlorobromoiodide, (b) a hydroxytetrazaindene compound and (c) a nitrogen-containing hetrocyclic compound having at least one mercapto group, the grains of said silver halide having such a size distribution that the variation coefficient is not more than 0.15.

DETAILED DESCRIPTION OF THE PREFERRED EMBODIMENTS

The silver halide grains making up the silver halide in the emulsion of the present invention are monodisperse in that they have such a size frequency distribution that the variation coefficient is not more than 0.15. More specifically, the monodisperse silver halide grains according to the present invention, when observed under an electron microscope, have similar shapes and a uniform size, as well as the variation coefficient of the particle size distribution defined by the following formulas:

$$\text{Variation coefficient} = \frac{s}{\bar{r}} \leqq 0.15;$$

$$S = \frac{\sqrt{\Sigma(\bar{r} - ri)^2 ni}}{\Sigma ni} = \text{Standard deviation; and}$$

$$\bar{r} = \frac{\Sigma niri}{\Sigma ni} = \text{Average particle size;}$$

wherein, $\Sigma ni$ is the total number of the silver halide grains observed, and ri is the size of the ith silver halide grain and when the size of individual grains is ri and their number is ni.

The term "particle or grain size" as used herein means the diameter if the silver halide grains are spherical, and the diameter of a circle of the same area as the projected area, which is directly viewed under microscope, of cubic or non-spherical grains.

The grain size as defined above can be determined by any of the methods conventionally used in the art, and typical techniques are described in Loveland, "Microscopy, 1955, pp. 94–122, and C. E. Kenneth Mees and T. H. James, supra, chapter 2. Generally, the grain size can be determined in terms of the projected area of particles or diameters of equivalent circles. If the particles are substantially uniform in shape, their size distribution can be expressed fairly accurately in terms of either the diameter or the projected area. More specifically, the particle size distribution can be determined by the method described in the article of Trivelli and Smith in "The Empirical Relation Between the Sensitometric Distribution and Particle Size Distribution in Photographic Emulsions", The Photographic Journal, LXXIX, 1949, pp. 330–338.

The monodisperse silver halide grains according to the present invention are made of silver chlorobromide or silver chloroiodobromide. They may also be made of a mixture of silver halides such as silver chloride and silver bromide. If the silver halide emulsion of the present invention is used in color photographic paper which requires particularly rapid development, the halide in the silver halide preferably contains chlorine atoms, and therefore, it is particularly preferred that the silver halide be made of silver chlorobromide or silver chloroiodobromide containing at least 1% of silver chloride.

The size of the monodisperse silver halide grains according to the present invention is not limited to any particular value. However, in order to achieve high developability, the preferred particle size is not more than 0.8 μm, and the size of not more than 0.5 μm is particularly preferred. Needless to say, the exact particle size varies with the specific chlorine content of the silver halide grains. If the silver halide used in the present invention is made of silver chloroiodobromide, the iodine content had better not exceed 2 mol % for the purpose of rapid development.

The silver halide grains that are subjected to chemical ripening according to the present invention may have regular shapes such as cubes, octahedrons or founteen-faced polyhedrons, or irregular shapes such as spheres. These forms may be combined in various ways so long as they are not deleterious to the objects of the present invention.

The monodisperse silver halide grains having such various forms can be prepared by any of the conventional methods such as the acid method, neutral method and ammoniacal method. If desired, seed grains may be first prepared by the acid method, and they are grown to the predetermined size by the ammoniacal method that achieves high growth rate. Silver halide grains may also be grown by the controlled double-jet method wherein the pH and pAg in the reactor are controlled while silver ions and halide ions are added simultaneously to the gelatin solution in the amounts commensurate with the growth rate of the silver halide grains, as shown in Japanese Patent Application (OPI) No. 48521/79.

These silver halide grains may be chemically sensitized y various sensitizers. Suitable sensitizers include active gelatin; sulfur sensitizers such as thiosulfate, allylthiocarbamide, thiourea and cystine; selenium sensitizers; reduction sensitizers such as stannous salts, thiourea dioxide and polyamines; noble metal sensitizers such as gold sensitizers (e.g. potassium aurothiocyanate, potassium chloroaurate and 2- aurothio-3-methylbenzothiazolium chloride) and water-soluble salts of ruthenium, palladium, platinum, rhodium and iridium (e.g. ammonium chloropalladate, potassium chloroplatinate and sodium chloropalladite.) Some of these compounds serve either as sensitizers or as antifoggants depending upon the amounts in which they are used. The above listed sensitizers may be used either alone or in combination (for example, gold sensitizers are combined with sulfur sensitizers or with selenium sensitizers).

The silver halide emulsion of the present invention is applied to a suitable photographic support to form a photosensitive silver halide emulsion layer. This emulsion layer is a dye-forming layer having sensitivity to a specific wavelength region, and it may be composed of more than one layer. This emulsion layer has photo-sensitivity to at least one of the following three wavelength regions, 400–500 nm, 500–600 nm and 600–700 nm. In the pages that follow, the silver halide emulsion layer having sensitivity to the region of 400–500 nm is referred to as a blue-sensitive emulsion layer, that having sensitivity to the region of 500–600 nm is referred to as a green-sensitive emulsion layer, and the one having sensitivity to the region of 600–700 nm is referred to as a red-sensitive emulsion layer.

The silver halide emulsion of the present invention is incorporated in at least one of the blue-, green- and red-sensitive emulsion layers. If the emulsion is incorporated in two or more emulsion layers, the silver halide grains in each layer must satisfy the stated requirement for the particle size distribution. If at least one of the three emulsion layers, say, the blue-sensitive emulsion layer, is made of more than one layer and contains the silver halide emulsion of the present invention, the silver halide grains in that specific layer must satisfy the stated requirement for the particle size distribution.

As already mentioned, the silver halide emulsion of the present invention is characterized by incorporating in combination (a) the silver halide which is made of silver chlorobromide or silver chlorobromoiodide grains having such a size distribution that the variation co-efficient is not more than 0.15, (b) a hydroxytetrazaindene compound and (c) a nitrogen-containing heterocyclic compound having at least one mercapto group. As will be specifically shown in the working examples given later in this specification, the combination of these three components brings about an entirely unexpected result: even if the concentration of bromide ions in 1,000 ml of a developing solution varies greatly from 0.8 g to 2.4 g or 1.0 g to 2.4 g in terms of KBr, the photographic properties of the emulsion do not change at all, indicating its excellent stability.

It is not completely clear why the emulsion with a high degree of monodispersity can be stabilized so effectively against variations in the concentration of bromide ions by combining it with the hydroxytetrazindene compound and the nitrogen-containing heterocyclic compound having at least one mercapto group. However, a plausible reason is that the two compounds interact with the developing nuclei so as to influence the developability of the emulsion. The accuracy of this assumption seems to be verified by the fact that a silver halide emulsion comprising large grains or having a low chlorine content compared with the iodine content can be rendered highly stable by combining it with the hydroxytetrazidene compound and the nitrogen-containing heterocyclic compound having at least one mercapto group. Usually, as compound having at least one mercapto group. Usually, as the concentration of bromide ions in the developer increases, a silver halide emulsion having high chlorine content or comprising large grains or having a relatively low developability due to the iodine content is desensitized by a greater extent than a highly developable siliver halide emulsion, and in addition, the former type of emulsion has a greater tendency toward soft tone.

In a particularly preferred with respect to long-term stability of the emulsion of the present invention, the emulsion comprising monodisperse silver chlorobromide or silver chloroidobromide grains having such a size distribution that the variation coefficient is not more than 0.15 is chemically ripened at a pH of 6.2 or higher in the presence of the hydroxytetrazaindene compound before the addition of a sulfur-containing compound. In this preferred embodiment, the surface of the silver chlorobromide of chloriodobromide grains is covered with the complex of the hydroxytetrazaindene compound and silver ions and the reaction with the photographically active sulfur-containing compound on the surface of the silver halide grains is either inhibited completely or restricted in terms of the reaction sites. As a result, the reaction with the sulfur-containing compound on the silver halide grains is limited to the inherently highly reactive species (e.g. the kink position on crystals, or the more reactive site of a specific kink position), and only the photosensitive nuclei that have stable energy levels are formed. The formation of these stable sensitive nuclei would be one of the factors that contribute to the improved long-term stability of the emulsion of the present invention for use in color photogrphic papers.

It will be apparent from the foregoing discussion that the order of addition of the hydroxytetrazaindene compound and the sulfur-containing compound for effecting the chemical ripening of the emulsion is important for providing the long-term stability of the emulsion. Preferably, the hydroxytetrazaindene compound is first added, and then, the sulfur-containing compound is added to start the chemical ripening.

In the other embodiment, the chemical ripening is effected at a pH of 6.2 or higher. This is because the competing reaction between the hydroxytetrazaindene compound and the sulfur-containing compound for the interlattice silver ions or the surface of silver halide grains during the chemical ripening largely depends on the pH of the reaction medium. More specifically, as is generally known in the art, (1) the chemical ripening by the sulfur-containing compound is accelerated as the pH is increased; (2) as the pH is increased, the hydroxytetrazaindene compound is dissociated at a faster speed in aqueous solutions; and (c) the degree of adsorption (or coverage) of the silver complex of the hydroxytetrazaindene compound on the silver halide grains varies with the pH of the reaction medium.

In a particularly preferred embodiment, the hydroxytetrazaindene compound is first added to the silver halide emulsion, then the pH of the mixture is adjusted to 6.2 or higher, and thereafter, the sulfur-containing compound is added to start the chemical ripening of the emulsion. The preferred pH range is from 6.2 and 10.0, and a particularly preferred range is from 6.2 and 9.0.

The following three types of compounds can be used as the hydroxytetrazaindene compound in the present invention:

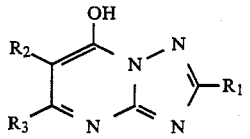

Formula (1)

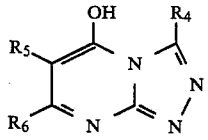

Formula (2)

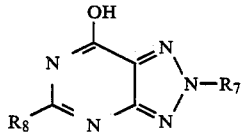

Formula (3)

wherein $R_1$ to $R_8$ which may be the same or different each represent a hydrogen atom; an aliphatic residue such as an alkyl group (e.g. methyl, ethyl, propyl, pentyl, hexyl, octyl, isopropyl, sec-butyl, t-butyl, cyclohexyl, cyclopentylmethyl or 2-norbonyl), an alkyl group substituted by an aromatic residue (e.g. benzyl, phenetyl, benzhydryl, 1-naphthylmethyl or 3-phenylbutyl), an alkyl group subsituted by an alkoxy group (e.g. methoxymethyl, 2-methoxyethyl, 3-ethoxypropyl or 4-methoxybutyl), an alkyl group substituted by a hydroxy, carbonyl or alkoxycarbonyl group (e.g. hydroxymethyl, 2-hydroxymethyl, 3-hydroxybutyl, carboxymethyl, 2-carboxyethyl or 2-(methoxycarbonyl-)ethyl); and an aromatic residue such as an aryl group (e.g. phenyl or 1-naphthyl), a substituted aryl group (e.g. p-tolyl, m-ethylphenyl, m-cumenyl, mesityl, 2,3-xylyl, p-chlorophenyl, o-bromophenyl, p-hydroxyphenyl, 1-hydroxy-2-naphthyl, m-methoxyphenyl, p-ethoxyphenyl, p-carboxyphenyl, o-(methoxycarbonyl)phenyl, m-(ethoxycarbonyl)phenyl or 4-carboxy-1-naphthyl).

Specific hydroxytetrazaindene compounds are listed below for illustrative purposes only.

X-1: 4-Hydroxy-6-methyl-1,3,3a,7-tetrazaindene
X-2: 4-Hydroxy-6-phenyl-1,3,3a,7-tetrazaindene
X-3: 4-Methyl-6-hydroxy-1,3,3a,7-tetrazaindene
X-4: 2,6-Dimethyl-4-hydroxy-1,3,3a,7-tetrazaindene
X-5: 4-Hydroxy-5-ethyl-6-methyl-1,3,3a,7-tetrazaindene
X-6: 2,6-Dimethyl-4-hydroxy-5-ethyl-1,3,3a,7-tetrazaindene
X-7: 4-Hydroxy-5,6-dimethyl-1,3,3a,7-tetrazaindene
X-8: 4-Hydroxy-6-methyl-1,2,3a,7-tetrazaindene
X-9: 4-Hydroxy-6-phenyl-1,2,3a,7-tetrazaindene
X-10: 4-Hydroxy-1,2,3a,7-tetrazaindene
X-11: 4-Methyl-6-hydroxy-1,2,3a,7-tetrazaindene.

The nitrogen-containing heterocyclic compound used in the present invention which has at least one mercapto group is preferably such that the hetero ring is selected from among imidazoline, imidazole, imidazolone, pyrazoline, pyrazole, pyrazolone, oxazoline, oxazole, oxazolone, thiazoline, thiazole, thiazolone, selenazoline, selenazole, selenazolone, oxadiazole, thiadiazole, triazole, tetrazole, benzoimidazole, benzotriazole, indazole, benzoxazole, benzothiazole, benzoselenazole, pyridine, pyrimidine, pyridazine, triazine, oxazine, thiazine, tetrazine, quinazoline, phthalazine, and polyazaindene (e.g. triazaindene, tetrazaindene or pentazaindene) rings.

More specifically, the nitrogen-containing heterocyclic compounds of the following formula (IV) are preferred:

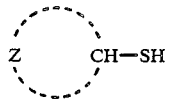

(IV)

wherein Z represents the atom or atomic group necessary for forming the imidazoline or polyazaindene ring that is listed above as a preferred hetero ring.

As will be apparent from the working examples given later in this specification, particularly good results are obtained when the hetero ring is a triazole tetrazole or tetrazole ring. Specific examples of the nitrogen-containing heterocyclic compound having at least one mercapto group are listed below for illustrative purposes only.

Y-1: 1-Phenyl-5-mercapto-tetrazole
Y-2: 1-Ethyl-5-mercapto-tetrazole
Y-3: 1-Ethyl-5-mercapto-tetrazole
Y-3: 3-Phenyl-5-mercapto-1,2,4-triazole
Y-4: 3-Mercapto-5-acetylamido-1,2,4-triazole
Y-5: 3-Mercapto-4-methyl-5-acetylamino-1,2,4-triazole
Y-6: 4-Amino-5-mercapto-1,2,4-triazole
Y-7: 2-Mercapto-5-amino-1,3,4-thiadiazole
Y-8: y-Hydroxy-2-mercapto-4-methylpyrimidine
Y-9: 2-Mercapto-1,3,4-thiadiazole
Y-10: 1-Benzoylamino-2-mercapto-5-phenyl-1,3,4-triazole.

The amount of the hydroxytetrazaindene compound incorporated in the silver halide emulsion of the present invention may vary over a wide range depending upon the specific type of the emulsion, and the preferred amount ranges from $1\times10^{-5}$ to $1\times10^{-2}$ mol per mol of silver. A more preferred range is from $1\times10^{-4}$ to $5\times10^{-3}$ mol per mol of silver. The amount of the nitrogen-containing heterocyclic compound having at least one mercapto group may also vary over a wide range depending upon the type of the emulsion. As a guide figure, the preferred range is from $1\times10^{-5}$ to $1\times10^{-2}$ mol per mol of silver, and the more preferred range is from $1\times10^{-4}$ to $1\times10^{-3}$ mol per mol of silver. The two compounds may be added to the emulsion in the same manner as used in the addition of conventional photographic addenda. For example, each compound is added in the form of a solution in water, or an acid or alkaline aqueous solution having a suitable pH, or an organic solvent such as methanol or ethanol.

The sulfur-containing compound used in the present invention to initiate chemical ripening is generally known as a sulfur sensitizer. Suitable examples include thiosulfate salts, allylthiocarbamide, thiourea, allylisothiacyanate, cystine, p-toluenethiosulfonate salts and polysulfides, as well as the compounds described in U.S. Pat. Nos. 1,574,944, 2,278,947, 2,410,689, 2,440,206, 3,187,458, 3,415,649 and 3,501,31; and French Pat. No. 2,059,245.

The amount of these sulfur-containing compounds also varies over a wide range depending upon various factors. As a guide figure, they are generally used in an amount of $10^{-7}$ to $10^{-3}$ mol, preferably from $10^{-6}$ to $10^{-4}$ mol, per mol of silver These compounds may be added by the conventional method in the form of a solution either in water or a water-miscible organic solvent. Part or all of the sulfur-containing compounds necessary may be supplied from chemically active gelatin.

These sulfur-containing compounds may be used as sensitizers together with salts of known noble metals such as platinum, palladium, iridium, rhodium and ruthenium. Selenium senstizers may also be used together with the sulfur compounds. Also usable are reduction sensitizers, as well as the silver chloride or silver sensitizers described in Japanese patent application (OPI) No. 1116/76.

The silver halide emulsion of the present invention may be prepared by the following procedure. The basic process consists of forming the desired silver halide in a hydrophilic colloidal aqueous solution such as gelatin solution by means of the reaction between a water-soluble silver salt and a water-soluble halide. In this case, the controlled double-jet method shown in Japanese patent application (OPI) No. 48521/79 may be used, wherein the pH and pAg in the reactor are controlled in order to produce silver halide grains having a high degree of monodispersity as defined by $s/\bar{r}\leqq0.15$. To the resulting silver halide emulsion, at least one of the hydroxytetrazaindene compounds listed above is added, and the mixture is thoroughly agitated at a pH not less than the pKa. The pH of the emulsion may be preadjusted, and the only requirement that should be met is that the silver halide emulsion and the hydroxytetrazainden compound be thoroughly agitated at a pH not lower than the pKa to form an intimate mixture. Thereafter, the sulfur-containing compound is added to the mixture to effect its chemical ripening. Before, during or after this chemical ripening, the nitrogen-containing heterocyclic compound having at least one mercapto group is added.

When the silver halide emulsion of the present invention is used to prepare a silver halide photographic material, the following three embodiments are possible: (a) only the silver halide emulsion of the present invention makes up a single emulsion layer; (2) two or more types of the silver halide emulsion of the present invention comprising grains having different average sizes are mixed to form a single emulsion layer; and (3) the emulsion of the present invention is mixed with a conventional silver halide emulsion to form a single emulsion layer. The first two embodiments are preferred. It is also preferred that one emulsion layer contain at least 70% of the silver halide emulsion of the present invention on the basis of the weight of silver halide.

In order to prepare a color photographic paper from these emulsions, they must be superimposed on a suitable photographic support after they are spectrally sensitized to the desired wavelength regions. The silver halide emulsion of the present invention may be incorporated in at least one of the three emulsion layers having a specific sensitivity to different colors, namely, blue, green and red. If one or more of these photosensitive emulsion layers are composed of more than one layer, the silver halide emulsion of the present invention may also be incorporated in one or more of these multilayers.

The silver halide emulsion layers prepared according to the present invention may be spectrally sensitized to the desired wavelength regions by known spectral sensitizers such as cyanine dyes (e.g. zeromethine dyes, monomethine dyes, dimethine dyes and trimethine dyes) and merocyaine dyes. These sensitizers may be used either alone or in combination to effect supersensitization.

The spectrally sensitized silver halide emulsions may incorporate respective couplers or compounds that react with the oxidization product of a specific color developing agent to form a dye. For the purposes of the present invention, known couplers such as yellow, magenta and cyan couplers may be used. Preferred couplers include $\alpha$-acylacetanilide yellow couplers, 5-pyrazolone magenta couplers, pyrazolinobenzoimidazole magenta couplers, pyrazolo triazole magenta couplers, indazolone magenta couplers, phenolic cyan couplers, and naphtholic cyan couplers.

These couplers may be 2-equivalent, 4-equivalent or polymeric. If they are alkali-soluble, they may be added in the form of an alkaline aqueous solution. If they are oil-soluble, they are preferably added to the silver halide emulsions in the form a solution in a suitable high-boiling solvent, optionally in combination with a low-boiling solvent, as shown in U.S. Pat. Nos. 2,322,027, 2,801,170, 2,801,171, 2,272,191 and 2,304,940. If necessary, other couplers, hydroquinone derivatives, UV absorbers and anti-discoloration agents may also be used. The couplers may be used either alone or in admixture.

Suitable high-boiling solvents include di-n-butyl phthalate, tricresyl phosphate, dioctyl phthalate and n-nonylphenol. Suitable low-boiling solvents include methyl acetate, butyl propionate, cyclohexanol and diethylene glycol monoacetate. These solvents may be used either alone or in combination. The couplers dissolved in these solvents are added to an aqueous solution containing a hydrophilic binder such as gelatin that contains an anionic surfactant (e.g. alkylbenzenesulfonate or alkylnaphthalenesulfonate) and/or a nonionic surfactant (e.g. sorbitan monolaurate ester), and the mixture is added to the silver halide emulsion after it is thoroughly agitated with a colloid mill or an ultrasonic disperser.

The couplers used in the present invention may also be dispersed in latices, as shown in Japanese Patent Application (OPI) Nos. 74538/74, 59943/76 and 32552/79, as well as Research Disclosure No. 14850 (August 1976), pp. 77–79. Suitable latices include homopolymers, copolymers or terpolymers of various monomers such as styrene, ethyl acrylate, n-butyl acrylate, n-butyl methacrylate, 2-acetoacetoxyethyl methacrylate, 2-(methacryloyloxy)ethyltrimethyl ammonium sulfate, sodium 3-(methacryloyloxy)propane-1-sulfonate, N-isopropylacrylamide, N-{2-(2-methyl-4-oxopentyl)}acrylamide, and 2-acrylamido-2-methylpropanesulfonic acid.

The silver halide emulsion layers incorporating the silver halide emulsion of the present invention may be combined with couplers in the same manner as in the ordinary color photographic materials (i.e. the color to which a specific emulsion layer is sensitive is complementary to the color of the dye that is formed by the coupler incorporated in that emulsion layer). Alternatively, the color combination may be the same as used in the false color system: a magenta coupler is combined with a blue-sensitive emulsion layer, a yellow coupler with a green-sensitive emulsion layer, and a cyan coupler with a red-sensitive emulsion layer. For details of the arrangement of the emulsion layers and other layers used to produce color photographic materials with silver halide emulsion of the present invention, see Research Disclosure, vol. 176, No. 17643, vol. 184, No. 18431, and vol. 187, No. 18716.

Suitable examples of the UV absorber that can be used in combination with the couplers include thiazolidone, benzotriazole and benzophenone compounds. These compounds are effective in preventing discoloration due to actinic radiation of shorter wavelengths. A particularly effective compound is Tinuvin (produced by Ciba-Geigy Corporation) which may be used either alone or in combination with other UV absorbers.

The hydroquinone derivatives that may be used with the couplers include their precursors. Examples of the anti-discoloration agent that may also be used with the couplers include chroman, cumarone and spirochroman compounds.

The color photographic material using the silver halide emulsions of the present invention can be processed by the conventional color development method in order to form an image. The negative-positive process consists basically of color development, bleaching and fixing steps. These steps may be performed independently. But two or more steps may be completed by a single processing solution capable of performing the respective steps simultaneously. Suitable examples are a combined color processing solution containing both a color developing agent, a ferric salt bleaching component and a thiosulfate salt fixing component, and a combined bleach-fixing bath containing ethylenediaminetetraacetic acid iron (III) complex salt bleaching component and a thiosulfate salt fixing component.

There is no particular limit on the method for processing the color photographic material using the silver halide emulsions of the present invention, and any conventional methods may be used. Typical methods are listed below: (1) a process consisting of color development, bleach-fixing, followed by optional rinsing and stabilizing steps; (2) a process consisting basically of color development and separate bleaching and fixing steps, optionally followed by rinsing and stabilizing steps; (3) a process consisting of sequential steps of prehardening, neutralization, color development, stop fixing, rinsing, bleaching, fixing, rinsing, afterhardening and rinsing; (4) a process consisting of successive steps of color development, rinsing, auxiliary color development, stopping, bleaching, fixing, rinsing and stabilization; and (5) a process wherein the silver produced by color development is halogenation-bleached, and subsequently subjected to another color development so as to form more dye.

The color developing solution used in processing the silver halide emulsions of the present invention is an aqueous alkaline solution which contains a suitable developing agent and has a pH of 8 or more, preferably in the range of 9 to 12. The aromatic primary amine as the developing agent means a compound that has a primary amino group on the aromatic ring and which is capable of developing the exposed silver halide, as well as a precursor that forms such a compound.

Typical developing agents are p-phenylenediamine compounds of the types listed below: 4-amino -N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-{β-(β-methoxyethoxy)-ethoxy}ethyl-3-methyl-4-aminoaniline, and N-ethyl-N-β-(β-methoxyethoxy)ethyl-3-methyl-4-aminoaniline, as well as salts thereof such as sulfates, hydrochlorides, sulfites and p-toluenesulfonates.

Other examples of the developing agent are listed in Japanese patent application (OPI) Nos. 64932/73, 131526/75 and 95849?76, and Vent, "Journal of the American Chemical Society", vol. 73, pp. 3100–3125 (1951).

The amount of these aromatic primary amino compounds used depends on the desired activity of the final developing solution. For providing higher activity, more of these compounds should be used. Generally, these compounds are used in an amount ranging from 0.0002 mol to 0.7 mol/1,000 ml of the developing solution. Depending on the specific object, two or more of these aromatic primary amino compounds may be used in combination. Two typical combinations are 3-methyl-4-amino-N,N-diethylaniline with 3-methyl-4-amino-N-ethyl-N-β-methanesulfonamidoethylaniline, and 3-methyl-4-amino-N-ethyl-N-β-methanesulfonamidoethylaniline with 3-methyl-4-amino-N-ethyl-N-β-hydroxyethylaniline.

The color developing solution used in the present invention may further contain commonly employed additives such as alkali agents (e.g. sodium hydroxide and sodium carbonate); alkali metal sulfites, alkali metal bisulfites, alkali metal thiocyanates and alkali metal halides; benzyl alcohol; water softeners; thickeners; and development accelerators.

Other additives that may be incorporated in the color developing solution include bromides such as potassium bromide and ammonium bromide; various compounds for rapid development such as alkali iodides, nitrobenzoimidazole, mercaptobenzoimidazole, 5-methyl-benzotriazole and 1-phenyl-5-mercaptotetrazole; anti-stain agents, anti-sludge agents; preservatives; interlayer effect accelerators; and chelating agents.

Examples of the bleaching agent incorporated in the bleaching solution or bleach-fixing solution are aminopolycarboxylic acids or organic acids such as oxalic acid and citric acid which are coordinated with metal ions such as iron, cobalt and copper. Typical aminopolycarboxylic acids include ethylenediaminetetraacetic acid, diethylenetriaminepentaacetic acid, propylenediaminetetraacetic acid, nitrilotriacetic acid, iminodiacetic acid, ethyletheraminetetraacetic acid, ethylenediaminetetrapropionic acid, ethylenediaminetetraacetic acid disodium salt, diethylenetriaminepentaacetic acid pentasodium salt, and nitrilotriacetic acid sodium salt.

The bleaching solution may also contain various additives other than the above listed bleaching agents. If a bleach-fixing solution is used, it should contain, in addition to the bleaching agents, a suitable silver halide fixing agent such as thiosulfate salts, thiocyanate salts or thioureas. The bleach-fixing solution may also contain a halogen compound such as potassium bromide. As in the case of the bleaching solution, the bleach-fixing solution may further contain various additives such as pH buffers, brightening agents, antifoaming agents, surfactants, preservatives, chelating agents, stabilizers and organic solvents.

Suitable silver halide fixing agents include sodium thiosulfate, ammonium thiosulfate, potassium thiocyanate, sodium thiocyanate, thiourea, thioether and other compounds that react with silver halide to form water-soluble silver salts and which are commonly used for fixing purposes. The fixing solution having the above specified composition may optionally contain, either alone or in combination, pH buffers such as boric acid, sodium hydroxide, sodium bicarbonate, acetic acid and sodium acetate. Other additives that may be incorporated in the fixing solution are brighteners, anti-foaming agents, surfactants, preservatives, chelating agents, stabilizers or organic solvents. The fixing solution may even contain conventional fixing accelerators as required.

The advantages of the present invention will become apparent by reading the following examples, to which the scope of the invention is by no means limited.

EXAMPLE 1

Three emulsion (Em) samples having the characteristics shown in Table 1 were prepared by the controlled double-jet method described in Japanese patent application (OPI) No. 48521/79.

TABLE 1

| Em. No. | Halide composition | $\bar{r}$ (μ) | $s/\bar{r}$ | Grain form |
|---|---|---|---|---|
| A-1 | $AgBr_{70}Cl_{30}$ | 0.3 | 0.06 | cubic |

TABLE 1-continued

| Em. No. | Halide composition | $\bar{r}$ (μ) | s/$\bar{r}$ | Grain form |
|---|---|---|---|---|
| A-2 | $AgBr_{70}Cl_{30}$ | 0.3 | 0.10 | 14-faced |
| A-3 | $AgBr_{70}Cl_{30}$ | 0.3 | 0.12 | cubic |

To each emulsion sample, 50 mg of a sensitizing dye (compound A shown below) and $2.0\times10^{-5}$ mol of sodium thiosulfate per a mol of silver were added, and then the pH of the mixture was adjusted (for the pH value, see Table 2). Thereafter, the hydroxytetrazaindene compound X-1 was added to start the chemical ripening (for the amount, see Table 2), and thereafter, the nitrogen-containing heterocyclic compound Y-1 was added (for the amount, see Table 2).

Compound A:

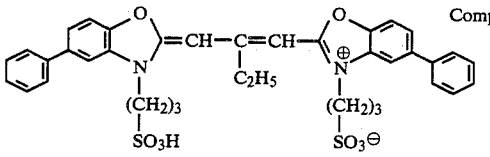

A magenta coupler (2.5 g, compound B indicated below) was dissolved in a mixture of dibutyl phthalate (2.5 ml) and ethyl acetate (7.5 ml) at 60° C. The resulting solution was added to 70 ml of an aqueous solution (40° C.) containing gelatin (3.5 g) and sodium dodecylbenzenesulfonate (0.25 g). The mixture was vigorously stirred in a homogenizer so as to prepare a coupler dispersion.

The coupler dispersion was mixed with each of the previously prepared green-sensitive silver chlorobromide emulsions. To the mixture, 10 ml of 3% methanol solution of 1,3,5-triacryloyl-hexahydro-s-triazine was added. After adjusting the pH of the mixture to a final value of 6.2, the mixture was applied to a polyethylese-coated paper base to form an emulsion layer having a silver content of 0.3 g/m², a gelatin content of 1.7 g/m² and a magenta coupler content of 0.41 g/m².

Compound B:

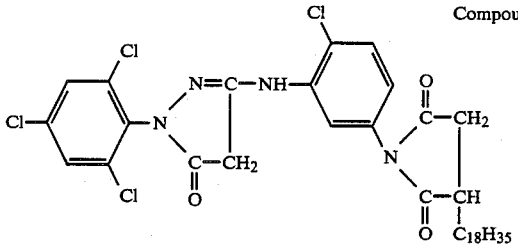

The resulting fifteen samples of photographic paper were exposed to a green light through an optical wedge and subsequently processed under the following conditions.

| Processing steps | Temp. (°C.) | Time |
|---|---|---|
| Color development | 33 | 3 min. |
| Bleach-fixing | 33 | 2 min. |
| Rinsing | 33 | 2 min. |

Color developer A:

| | |
|---|---|
| Anhydrous sodium carbonate | 2.6 g |
| Anhydrous sodium bicarbonate | 3.5 g |
| Potassium sulfite | 18 g |
| Potassium bromide | 0.8 g |
| Potassium hydroxide | 0.4 g |
| Hydroxylamine sulfate | 2 g |
| 4-Amino3-methyl-N—ethyl-N—(β-methanesulfonamidoethyl)-aniline | 5 g |
| Water to make 1,000 ml (pH 10.2) | |

Color developer B:

This developer had the same composition as that of color developer A except that the potassium bromide content was increased to 2.4 g.

| Bleach-fixing solution: | |
|---|---|
| Ammonium thiosulfate | 100 g |
| Potassium sulfite | 5 g |
| Na{Fe(EDTA)} | 40 g |
| EDTA | 4 g |
| Water to make 1,000 ml | |

The photographic characteristics of the samples processed immediately after their preparation by the two color developers having different bromide ion concentrations are shown in Table 2. In the table, gamma (γ) represents the gradation in tone of the area of the characteristic curve having a reflection density of 0.5–0.8; $S_1$ represents the sensitivity obtained by processing with color developer A; and $S_2$ represents the sensitivity obtained by processing with developer B and is indicated in terms of a relative value with $S_1$ taken as 100. Therefore, the deviation of $S_2$ from 100 indicates the degree of desensitization that occurred as a result of the increase in bromide ion concentration (as KBr) from 0.8 g to 2.4 g/1,000 ml.

The figures in the columns "pH in ripening" in Table 2 represent pH values measured immediately before the addition of sodium thiosulfate. The relative sensitivity noted in the table means the reciprocal of an exposure necessary to provide a density equal to fog+0.3 on the sensitometric curve, and the gradation represents the gradient of the straight line connecting the points for densities in the range of 0.8 to 1.8.

Furthermore, the photographic paper samples were stored at 49° C. and 80% R. H. for 14 days. They were then exposed and processed with developer A in the same manner described above. The photographic characteristics of the samples as determined after the 14-day storage are also shown in Table 2. The sensitivity of the stored samples was indicated in terms of a relative value with the sensitivity of the fresh samples taken as 100.

TABLE 2

| Sample No. | Em. No. | S/$\bar{r}$ | $\bar{r}$(μ) | pH in ripening | Sodium thiosulfate (× $10^{-5}$ mol) | Compound (X-I) (× $10^{-3}$ mol) | Compound (Y-I) (× $10^{-3}$ mol) | Processing before storage: Developer A F | Developer A $S_1$ | Developer A γ | Developer B F | Developer B $S_2$ | Developer B γ | Relative sensitivity after storage (use of Developer A) |
|---|---|---|---|---|---|---|---|---|---|---|---|---|---|---|
| 1 | A-1 | 0.06 | 0.3 | 7.0 | 2.0 | 8.4 | 1.85 | 0.02 | 100 | 3.4 | 0.02 | 100 | 3.4 | 103 |

TABLE 2-continued

| Sample No. | Em. No. | $S/\bar{r}$ | $\bar{r}(\mu)$ | pH in ripening | Sodium thiosulfate ($\times 10^{-5}$ mol) | Compound (X-I) ($\times 10^{-3}$ mol) | Compound (Y-I) ($\times 10^{-3}$ mol) | Processing before storage: Developer A F | Developer A $S_1$ | Developer A $\gamma$ | Developer B F | Developer B $S_2$ | Developer B $\gamma$ | Relative sensitivity after storage (use of Developer A) |
|---|---|---|---|---|---|---|---|---|---|---|---|---|---|---|
| 2 | A-1 | 0.06 | 0.3 | 5.9 | 2.0 | 8.4 | 1.85 | 0.03 | 100 | 3.5 | 0.02 | 100 | 3.6 | 120 |
| 3 | A-1 | 0.06 | 0.3 | 7.0 | 2.0 | 8.4 | 0 | 0.06 | 100 | 3.6 | 0.05 | 72 | 3.9 | 72 |
| 4 | A-1 | 0.06 | 0.3 | 7.0 | 2.0 | 0 | 1.85 | 0.11 | 100 | 2.4 | 0.10 | 70 | 2.9 | 63 |
| 5 | A-1 | 0.06 | 0.3 | 7.0 | 2.0 | 0 | 0 | 0.24 | 100 | 2.0 | 0.20 | 67 | 2.2 | 41 |
| 6 | A-2 | 0.10 | 0.3 | 6.7 | 1.4 | 9.0 | 2.0 | 0.02 | 100 | 3.2 | 0.02 | 100 | 3.1 | 102 |
| 7 | A-2 | 0.10 | 0.3 | 4.5 | 1.4 | 9.0 | 2.0 | 0.02 | 100 | 3.3 | 0.02 | 100 | 3.2 | 125 |
| 8 | A-2 | 0.10 | 0.3 | 6.7 | 1.4 | 9.0 | 0 | 0.05 | 100 | 3.2 | 0.03 | 73 | 3.4 | 73 |
| 9 | A-2 | 0.10 | 0.3 | 6.7 | 1.4 | 0 | 2.0 | 0.15 | 100 | 2.4 | 0.13 | 71 | 2.8 | 64 |
| 10 | A-2 | 0.10 | 0.3 | 6.7 | 1.4 | 0 | 0 | 0.19 | 100 | 2.5 | 0.17 | 66 | 2.6 | 44 |
| 11 | A-3 | 0.12 | 0.3 | 6.5 | 2.45 | 10.4 | 1.85 | 0.03 | 100 | 3.4 | 0.03 | 98 | 3.4 | 98 |
| 12 | A-3 | 0.12 | 0.3 | 5.5 | 2.45 | 10.4 | 1.85 | 0.02 | 100 | 3.5 | 0.02 | 97 | 3.4 | 123 |
| 13 | A-3 | 0.12 | 0.3 | 6.5 | 2.45 | 10.4 | 0 | 0.11 | 100 | 3.6 | 0.09 | 71 | 3.7 | 74 |
| 14 | A-3 | 0.12 | 0.3 | 6.5 | 2.45 | 0 | 1.85 | 0.24 | 100 | 2.5 | 0.22 | 70 | 2.8 | 63 |
| 15 | A-3 | 0.12 | 0.3 | 6.5 | 2.45 | 0 | 0 | 0.34 | 100 | 2.1 | 0.30 | 66 | 2.6 | 44 |

As Table 2 shows, samples Nos. 1, 2, 6, 7, 11 and 12 of the present invention proved more stable than comparative samples Nos. 3, 4, 5, 8, 9, 10, 13, 14 and 15 because their photographic characteristic curves did not change at all or varied only slightly (only a few percent desensitization) even when the concentration of bromide ions in the developer changed from 0.8 g to 2.4 g/1,000 ml. Furthermore, the emulsions incorporated in samples Nos. 1, 2, 6, 7, 11 and 12 experienced a small variation in sensitivity during storage under hot and humid conditions.

EXAMPLE 2

Silver chloroiodobromide emulsion sample B-1 and silver chlorobromide emulsion samples B-2 to B-8 were prepared by the controlled double-jet method as in Example 1. The compositions, average particle sizes and the size distributions of the respective samples are shown in Table 3.

TABLE 3

| Em. No. | Halide composition (mol. %) | $\bar{r}$ ($\mu$) | $s/\bar{r}$ |
|---|---|---|---|
| B-1 | 49.5:Br, 50:Cl, 0.5:I | 0.45 | 0.10 |
| B-2 | 90:Br, 10:Cl | 0.49 | 0.09 |
| B-3 | 30:Br, 70:Cl | 0.26 | 0.06 |
| B-4 | 50:Br, 50:Cl | 0.26 | 0.07 |
| B-5 | 50:Br, 50:Cl | 0.26 | 0.14 |
| B-6 | 50:Br, 50:Cl | 0.26 | 0.18 |
| B-7 | 50:Br, 50:Cl | 0.26 | 0.20 |
| B-8 | 50:Br, 50:Cl | 0.26 | 0.31 |

The emulsion samples were chemically ripened under the conditions listed in Tables 4 to 7. They were then stored at 49° C. and 80% R. H. for 14 days. The photographic characteristics of the emulsions as determined immediately after their preparation and after the 14-day storage are shown in Tables 4–7. The sensitivity of the stored samples was indicated in terms of a relative value with the sensitivity of the fresh emulsions taken as 100. The symbol P used in Tables 4–7 means that in the chemical ripening, the hydroxytetraazaindene compound was first added, and then, after thorough agitation, a sulfur-containing compound (e.g. sodium thiosulfate) was added; and Q means that the order of addition of the two compounds was reversed.

A magenta coupler 2.5 g, compound B shown above) was dissolved in a mixture of dibutyl phthalate (2.5 ml) and ethyl acetate (7.5 ml) at 60° C. The resulting solution was added to 70 ml of an aqueous solution (40° C.) containing gelatin (3.5 g) and sodium dodecylbenzenesulfonate (0.25 g). The mixture was vigorously stirred in a homogenizer so as to prepare a coupler dispersion.

The coupler dispersion was mixed with each of the previously prepared green-sensitive silver halide emulsions. To the mixture, 10 ml of 3% methanol solution of 1,3,5-triacryloyl-hexahydro-s-triazine was added. After adjusting the pH of the mixture to a final value of 6.2, the mixture was applied to a polyethylene-coated paper base to form an emulsion layer having a silver content of 0.3 g/m$^2$, a gelatin content of 1.7 g/m$^2$ and a magenta coupler content of 30 mol % of the silver halide.

In the above process, the chemical ripening was effected at 60° C. and the ripening period, which usually varied with the other conditions of the ripening and the type of the specific emulsion, was selected at a duration of about 2 hours which was considered to be sufficient for providing optimum photographic characteristics before the storage. The pH of the emulsion under the chemical ripening was adjusted with 1% aqueous potassium hydroxide and 1% aqueous sulfuric acid immediately after the ripening was started. In order to render the emulsions sensitive to green light, 50 mg per mol of silver of compound A (identified above) was added as a sensitizing dye after the pH adjustment was finished.

After the completion of the chemical ripening, 0.05% of the nitrogen-containing heterocyclic compound having a mercapto group as defined in this specification was added. And, $7\times10^{-3}$ mol of hydroxytetraazaindene compound (X-1) was added after the completion of the chemical ripening in the form of a 0.5 wt. % aqueous solution. After thorough agitation, the mixture was cooled to 40° C.

The photographic paper samples thus prepared were exposed to a green light through an optical wedge and subsequentially processed under the following conditions.

| Processing steps | Temp. (°C.) | Time |
|---|---|---|
| Color development | 33 | 3 min. |
| Bleach-fixing | 33 | 2 min. |
| Rinsing | 33 | 2 min. |

Color developer C:

| | |
|---|---|
| Anhydrous sodium carbonate | 2.6 g |
| Anhydrous sodium bicarbonate | 3.5 g |
| Potassium sulfite | 18 g |

-continued

| | |
|---|---|
| Sodium chloride | 0.2 g |
| Potassium bromide | 1.0 g |
| Potassium hydroxide | 0.4 g |
| Hydroxylamine sulfate | 2 g |
| 4-Amino-3-methyl-N—ethyl-N—(β-methanesulfonamidoethyl)-aniline | |
| Water to make 1,000 ml (pH 10.2) | |

Color developer D:

This developer had the same composition as that of color developer C except that the potassium bromide content was increased to 2.4 g.

| Bleach-fixing solution: | |
|---|---|
| Ammonium thiosulfate | 100 g |
| Potassium sulfite | 5 g |
| Ethylenediaminetetraacetic acid iron (III) sodium salt | 40 g |
| Ethylenediaminetetraacetic acid | 4 g |
| Water to make 1,000 ml | |

The photographic characteristics of thus-prepared photographic paper samples processed by the two color developers having different bromide ion concentrations are shown in Tables 4–7. In the tables, gamma (γ) represents a same meaning as in Example 1; $S_1$ represents the sensitivity obtained by processing with color developer C; and $S_2$ represents the sensitivity obtained by processing with developer D and is indicated in terms of a relative value with $S_1$ taken as 100. Therefore, the deviation of $S_2$ from 100 indicates the degree of desensitization that occurred as a result of the increase in bromide ion concentration (as KBr) from 1.0 g to 2.4 g/1,000 ml.

The figures in the columns "pH in ripening" in Table 4–7 represent pH values measured immediately before the addition of sodium thiosulfate. The relative sensitivity noted in the tables means the reciprocal of an exposure necessary to provide a density equal to fog+0.3 on the sensitometric curve, and the gradation represents the gradient of the straight line connecting the points for densities in the range of 0.8 to 1.8.

TABLE 4

| Em. No. | pH in ripening | Ripening method | Compound X and its amount ($10^{-4}$ mol/mol. Ag) | Compound Y and its amount ($10^{-4}$ mol/mol. Ag) | Amount of sodium thiosulfate hemihydrate ($10^{-5}$ mole/mol. Ag) | Processing before storage: Developer C F | Developer C $S_1$ | Developer C γ | Developer D F | Developer D $S_2$ | Developer D γ | Processing after storage (Developer C) |
|---|---|---|---|---|---|---|---|---|---|---|---|---|
| 16 B-4 | 7.0 | P | (X-1) 13.2 | (Y-5) 1.86 | 1.50 | 0.02 | 100 | 3.8 | 0.02 | 100 | 3.8 | 100 |
| 17 B-5 | 7.0 | P | (X-1) 13.2 | (Y-5) 1.86 | 1.50 | 0.01 | 100 | 3.8 | 0.01 | 97 | 3.7 | 103 |
| 18 B-6 | 7.0 | P | (X-1) 13.2 | (Y-5) 1.86 | 1.50 | 0.01 | 100 | 3.7 | 0.01 | 74 | 4.0 | 82 |
| 19 B-7 | 7.0 | P | (X-1) 13.2 | (Y-5) 1.86 | 1.50 | 0.02 | 100 | 3.2 | 0.01 | 72 | 3.7 | 83 |
| 20 B-8 | 7.0 | P | (X-1) 13.2 | (Y-5) 1.86 | 1.50 | 0.02 | 100 | 3.4 | 0.01 | 65 | 3.9 | 72 |

TABLE 5

| Em. No. | pH in ripening | Ripening method | Compound X and its amount ($10^{-4}$ mol/mol. Ag) | Compound Y and its amount ($10^{-4}$ mol/mol. Ag) | Amount of sodium thiosulfate hemihydrate ($10^{-5}$ mol/mol. Ag) | Processing before storage: Developer C F | Developer C $S_1$ | Developer C γ | Developer D F | Developer D $S_2$ | Developer D γ | Processing after storage (Developer C) |
|---|---|---|---|---|---|---|---|---|---|---|---|---|
| 21 B-2 | 6.5 | P | (X-7) 6.8 | (Y-1) 1.50 | 1.00 | 0.02 | 100 | 3.5 | 0.02 | 89 | 3.7 | 110 |
| 22 B-2 | 6.5 | Q | (X-7) 6.8 | (Y-1) 1.50 | 1.00 | 0.03 | 100 | 2.7 | 0.02 | 85 | 3.0 | 69 |
| 23 B-3 | 7.0 | P | (X-1) 15.0 | (Y-5) 1.86 | 1.50 | 0.02 | 100 | 4.0 | 0.02 | 100 | 4.0 | 98 |
| 24 B-3 | 7.0 | Q | (X-1) 15.0 | (Y-5) 1.86 | 1.50 | 0.02 | 100 | 2.8 | 0.01 | 96 | 3.0 | 75 |

TABLE 6

| Em. No. | pH in ripening | Ripening method | Compound X and its amount ($10^{-4}$ mol/mol. Ag) | Compound Y and its amount ($10^{-4}$ mol/mol. Ag) | Amount of sodium thiosulfate hemihydrate ($10^{-5}$ mol/mol. Ag) | Processing before storage: Developer C F | Developer C $S_1$ | Developer C γ | Developer D F | Developer D $S_2$ | Developer D γ | Processing after storage (Developer C) |
|---|---|---|---|---|---|---|---|---|---|---|---|---|
| 25 B-5 | 4.0 | P | (X-1) 13.2 | (Y-5) 1.86 | 1.50 | 0.03 | 100 | 2.7 | 0.03 | 96 | 2.8 | 124 |
| 26 B-5 | 5.9 | P | (X-1) 13.2 | (Y-5) 1.86 | 1.50 | 0.03 | 100 | 3.0 | 0.02 | 95 | 3.0 | 115 |
| 27 B-5 | 6.5 | P | (X-1) 13.2 | (Y-5) 1.86 | 1.50 | 0.02 | 100 | 3.5 | 0.02 | 98 | 3.5 | 103 |
| 28 B-5 | 8.2 | P | (X-1) 13.2 | (Y-5) 1.86 | 1.50 | 0.02 | 100 | 4.1 | 0.02 | 95 | 4.1 | 105 |
| 29 B-5 | 9.0 | P | (X-1) 13.2 | (Y-5) 1.86 | 1.50 | 0.03 | 100 | 3.7 | 0.02 | 97 | 3.8 | 104 |

TABLE 7

| Em. No. | pH in ripening | Ripening method | Compound X and its amount ($10^{-4}$ mol/mol. Ag) | Compound Y and its amount ($10^{-4}$ mol/mol. Ag) | Amount of sodium thiosulfate hemihydrate ($10^{-5}$ mol/mol. Ag) | Processing before storage: Developer C F | Developer C $S_1$ | Developer C γ | Developer D F | Developer D $S_2$ | Developer D γ | Processing after storage (Developer C) |
|---|---|---|---|---|---|---|---|---|---|---|---|---|
| 30 B-1 | 8.0 | P | (X-1) 7.5 | (Y-2) 1.86 | 1.00 | 0.02 | 100 | 3.0 | 0.02 | 85 | 3.4 | 109 |
| 31 B-1 | 8.0 | P | (X-1) 7.5 | (Y-3) 1.86 | 1.00 | 0.02 | 100 | 3.3 | 0.02 | 91 | 3.3 | 104 |
| 32 B-1 | 8.0 | P | (X-1) 7.5 | (Y-4) 1.86 | 1.00 | 0.02 | 100 | 3.5 | 0.01 | 92 | 3.6 | 98 |
| 33 B-1 | 8.0 | P | (X-1) 7.5 | (Y-7) 1.86 | 1.00 | 0.02 | 100 | 2.9 | 0.02 | 85 | 3.4 | 92 |

Table 4 shows the correlation between the size distribution of silver halide grains in the emulsion under chemical ripening and the long-term stability of the emulsion. Samples No. 16 and No. 17 using the emulsions according to the present invention wherein $s/\bar{r} \leqq 0.15$ experienced a small variation in sensitivity during storage as compared with sample Nos. 18 to 20 using emulsions which were outside the scope of the present invention ($s/\bar{r} > 0.15$).

Table 5 shows the importance of the timing of the addition of the hydroxytetrazaindene compound during chemical ripening. Sample Nos. 21 and 23 using emulsions that had been chemically sensitized by adding a sulfurcontaining compound after the addition of the hydroxytetrazaindene compound had a small variation in sensitivity during storage as compared with samples Nos. 22 and 24 using emulsions that had been chemically ripened by adding sodium thiosulfate before the addition of the hydroxytetrazaindene compound.

Table 6 shows the relation between the variation in the pH of the emulsions during chemical ripening and the long-term stability of the emulsions. Samples Nos. 27 to 29 using emulsions that had been chemically ripened at pH values higher than 6.2 proved more stable than sample Nos. 25 and 26 outside the scope of the present invention.

What is claimed is:

1. A silver halide photographic paper having on a support at least one layer which contains a silver halide emulsion comprising in combination (a) silver halide made of silver chlorobromoiodide containing 0 to 2 mol % of iodine, (b) a hydroxytetrazaindene compound and (c) a nitrogen-containing heterocyclic compound having at least one mercapto group, the grains of said silver halide having such a size distribution that the variation coefficient is not more than 0.15.

2. A silver halide emulsion according to claim 1, wherein said silver halide (a) is chemically ripened at a pH of 6.2 or more in the presence of the hydroxytetrazaindene compound before the addition of a sulfur-containing compound.

3. A silver halide emulsion according to claim 1 or 2, wherein said nitrogen-containing heterocyclic compound (c) is a triazole compound.

4. A silver halide emulsion according to claim 1, wherein said variation coefficient is defined by the following formulas:

$$\text{Variation coefficient} = \frac{s}{\bar{r}}$$

$$S = \frac{\sqrt{\Sigma(\bar{r} - ri)^2\, ni}}{\Sigma ni} = \text{Standard deviation;}$$

$$\bar{r} = \frac{\Sigma niri}{\Sigma ni} = \text{Average particle size;}$$

wherein, $\Sigma ni$ is the total number of the silver halide grains observed, ri is the size of the ith silver halide grain, and when the size of individual grains is ri and their number is ni.

5. A silver halide emulsion according to claim 2, wherein said sulfur-containing compound is a sulfur sensitizer.

6. A silver halide emulsion according to claim 5, wherein said sulfur sensitizer is a thiosulfate.

* * * * *